United States Patent [19]

Dixon et al.

[11] 3,940,520

[45] Feb. 24, 1976

[54] SULFO-FLUORINATION OF SYNTHETIC RESINS

[75] Inventors: Dale D. Dixon, Kutztown; Larry J. Hayes, Trexlertown, both of Pa.

[73] Assignee: Air Products and Chemicals, Inc., Allentown, Pa.

[22] Filed: Feb. 19, 1974

[21] Appl. No.: 443,460

[52] U.S. Cl. ..... 427/444; 427/322; 427/400

[51] Int. Cl.[2] ..... B05D 3/00

[58] Field of Search ..... 117/118, 138.8 E, 138.8 G, 117/47 A; 427/399, 400, 444, 322

[56] References Cited

UNITED STATES PATENTS

| | | | |
|---|---|---|---|
| 2,129,289 | 9/1938 | Soll | 117/118 |
| 2,811,468 | 10/1957 | Joffre | 117/118 |
| 2,829,070 | 4/1958 | Osborn | 260/75 |
| 3,036,930 | 5/1962 | Grimminger et al. | 117/118 |
| 3,255,099 | 6/1966 | Wolinski | 117/47 |
| 3,364,056 | 1/1968 | Seibel | 117/118 |

*Primary Examiner*—Ralph Husack
*Assistant Examiner*—Sadie L. Childs
*Attorney, Agent, or Firm*—Russell L. Brewer; Barry Moyerman

[57] ABSTRACT

This invention relates to a process for improving the water wicking and moisture transport properties of synthetic resins, e.g., fiber form polyamides, polyesters, polyolefins, and polyacrylonitriles, which comprises sulfofluorinating said resins in a self-activating gaseous reaction medium containing from about 0.1–20% by volume elemental fluorine, 0.1–50% by volume of sulfur dioxide, 0–21% by volume oxygen, and the balance inert for providing from $1 \times 10^{-9}$ to $1 \times 10^{-3}$ milligrams fluorine and sulfur per square centimeter of resin surface.

5 Claims, No Drawings

SULFO-FLUORINATION OF SYNTHETIC RESINS

BACKGROUND OF THE INVENTION

As has been pointed out in copending applications, Ser. No. 434,285 and Ser. No. 434,284, filed Jan. 17, 1974, fluorinating fiber form synthetic resins to a relatively low level of from $4 \times 10^{-7}$ to $4 \times 10^{-1}$ mg F/cm$^2$ creates a surface fluorinated and carboxylated product with good stain release antiredeposition properties and significant water transport properties. The improvement in water transport, or wicking properties, are believed attributable to chain scission and formation of carboxylic acid groups which occur as an incident to the fluorination reactions, with the carboxylate level increasing along with increased fluorine incorporation.

Existence of an inter-relationship between carboxylate formation and fluorination intensity limits the levels of water transport (or wicking) attainable through increasing fluorination intensity. Actually, beyond certain levels, more intensive fluorination can decrease water transport.

It has now been discovered that conduct of the fluorination in the presence of sulfur dioxide creates enhanced moisture transport.

SUMMARY OF THE INVENTION

In accordance with the practice of the present invention, the surfaces of shaped articles formed from synthetic polymers are reacted with a gaseous treating medium comprising from 0.1–20% by volume elemental fluorine, 0.1–50% by volume sulfur dioxide, not more than about 21% by volume of elemental oxygen, e.g. air, the balance may be inert. Particularly improved are fiber form synthetic resins selected from the group consisting of polyesters, polyamides, polyolefins, and polyacrylonitriles, these being the materials fluorinated and carboxylated according to practice of the inventions disclosed in the above mentioned copending patent applications, reference being made thereto for detailed description of these preferred fiber form materials and for further discussion of the fluorination/carboxylation reaction.

In general, the fiber form materials are surface fluorinated to a fluorine content of from $1 \times 10^{-9}$ to $1 \times 10^{-3}$ mg F/cm$^2$, preferably $1 \times 10^{-8}$ to $1 \times 10^{-5}$ mg F/cm$^2$. The acidity increases as well. For example, the acidity of a typical nylon fabric will increase from $1.3 \times 10^{-5}$ meq/cm$^2$ to $1.6 \times 10^{-4}$ meq/cm$^2$.

The significant process aspects for practice of this invention may be recapitulated as follows:

1. A reaction contact time between resin and reaction gases of less than about 60 minutes, less than 30 minutes being more desirable, and less than 5 minutes preferred. For fiber form materials 0.5–5 minutes constitute the preferred treatment time.

2. A reaction gas composition having, by volume:

a. up to 20% elemental fluorine, less than 10% preferred, 0.5–5% being more desirable; specifically preferred is 1–3% for treatment of polyesters and polyacrylonitriles; 1–5% for treatment of polyamides and polyolefins.

b. limiting elemental oxygen content to not more than about 21%, i.e. air, desirably to less than 1%. For polyamides, polyolefins, polyacrylonitriles, and polyesters a reaction gas mixture substantially free of elemental oxygen is preferred. The polyolefins and polyacrylonitriles require (presence of) some oxygen, with 5% constituting an upper preferred level, the lower limit being the trace levels that normally cannot be removed from the reactor.

The above described overall conditions, and the presence of 0.1–50% $SO_2$, preferably 0.1–20% $SO_2$ in the reaction medium, increases the acidity (meq/cm$^2$) of the treated article. The exact acidity (meq/cm$^2$) obtained according to practice of this invention will depend upon the particular substrate. From $4 \times 10^{-6}$ to $1 \times 10^{-1}$ mgS/cm$^2$ may become incorporated on the resin surface. For brevity the reaction involved in practice of the present invention will hereafter be called sulfo-fluorination.

Within the context of this invention, fluorination in the presence of sulfur dioxide, i.e. sulfo-fluorination, is not limited to a gaseous reaction mixture containing elemental fluorine and free sulfur dioxide. It has been observed that elemental fluorine reacts with sulfur dioxide to an unknown degree to form sulfuryl fluoride. Confirmatory tests indicate a mixture of sulfuryl fluoride and fluorine can be employed for sulfo-fluorination and therefore, both sulfur dioxide, as such, and sulfuryl fluoride are considered sulfur dioxide for purpose of practice of this invention within the context thereof.

In the aforementioned copending applications, Ser. No. 434,284 and Ser. No. 434,285, the desirability of maintaining a low level of oxygen in the fluorinating medium was set out. One of the major reasons for limiting oxygen was to allow a rapid fluorination rate. (Oxygen has been shown to retard fluorine incorporation). However, sulfur dioxide either as such or as sulfuryl fluoride in the gaseous sulfo-fluorination reaction medium inhibits substrate fluorine incorporation to an equal or greater degree than does elemental oxygen. Therefore, the presence of oxygen in the sulfo-fluorination medium will not have the same drastic effect of retarding fluorine incorporation. The reduced effect of oxygen on the rate of fluorine incorporation through sulfo-fluorination, permits use of air as the carrier gas. Addition of sulfur dioxide and elemental fluorine to air in order to create the sulfo-fluorination reaction gas is contemplated for practice of this invention.

Although sulfo-fluorination according to practice of this invention has been posed largely within a context of fiber form polyesters, polyamides, polyolefins and polyacrylonitriles, this invention is not limited to fiber forms of these resins, nor indeed even to the above specified preferred resin materials. Other instances exist where surface fluorination-carboxylation in the presence of sulfur dioxide, i.e. sulfo-fluorination, will greatly improve a shaped synthetic polymer, regardless of the substrate material involved.

Sulfo-fluorination according to practice of this invention is applicable across the board to synthetic resins as a class, including for example, those already named as well as polystyrene, polyvinyl acetate, polyvinyl chloride, polyacrylates, polyvinylidine chloride, polyimides, polyarylsulfanes, polyurethanes, polycarbonates, etc., in all shaped polymer, copolymer or admixture modes.

PREFERRED EMBODIMENTS OF THE INVENTION

The sulfo-fluorination conducted according to practice of the present invention is of course particularly adapted to fiber form of polyesters, polyamides, polyolefins, polyacrylonitriles including, for example, fibers, filaments, yarns, threads, ribbons, etc. and articles formed therefrom, such as cloth and fabrics, knit, woven, non-woven. The treatment can be conducted on a continuous basis by passing polymeric fiber form materials through the gaseous treating medium within a suitable sealed reaction chamber equipped with gas-tight seals through which the material passes; if available on rolls the material may be treated by being rolled and rerolled within the sealed chamber. Alternatively the treatment may be a batch operation, in which the polymeric material (which may be in a roll) is exposed to the gas form reaction medium for a relatively short period of time, desirably at or near ambient temperature and pressures.

The gas composition and reaction conditions have been described above in an overall sense. To obtain best results with any particular material a cut and try approach may be required, reference being made to the specific examples hereinafter appended for sulfo-fluorination details which might be applicable thereto. Reference is also made to the aforementioned concurrently filed copending applications for a more elaborate discussion of the fluorination reactions, particularly as applied to the fiber forms.

Films, sheets, moldings, entire article, particularly of polyesters, polyamides, polyolefins and polyacrylonitriles can be sulfo-fluorinated under exactly the same conditions as fiber forms. Thus, in a preferred embodiment of this invention, polyolefin articles, notably blow molded containers made from polyethylene, are sulfo-fluorinated to achieve superior solvent resistance.

Fluorination of polyethylene containers has been suggested to the art as witness the teachings in U.S. Pat. Nos. 2,811,468 and 3,647,613 for improving the solvent barrier properties of polyethylene. Sulfo-fluorination further improves these properties. Copending application Ser. No. 358,985, filed May 10, 1973 relates to fluorinating during the course of the blow molding formation of a polyethylene container. A surface fluorination is affected within fractions of a second. Inclusion of sulfur dioxide as such or in the form of sulfuryl fluoride within the reaction gas as is herein contemplated, improves the resulting solvent barrier properties still further. Thus, the sulfo-fluorination of the present invention can, for shaped articles be affected much more rapidly than the 0.5–5 minute contemplated for fiber forms, and no lower limit for reaction time can reasonably be provided.

Although there is no intention of being bound by any one theoretical explanation of the nature of the treatment, it is believed that in sulfo-fluorination the fluorine randomly replaces hydrogen molecules in the polymeric chain under treatment and that chain scission and carboxylate formation takes place. It is believed that in addition the sulfur dioxide reacts with the fluorine to form $—SO_2F$ radicals which (randomly) replace hydrogen atoms in the chain to add pendant acidic groups on the surface of the shaped polymeric material.

Sealed reaction chambers used for the method of the present invention must be constructed to withstand the corrosive nature of the reactive gases, especially the elemental fluorine. The chamber should be designed to permit uniform contact between the gaseous treating medium and the polymeric material to be treated.

The invention is further illustrated by reference to the following Examples.

EXAMPLES 1 – 3

Samples of nylon 6.6, Testfabrics style 358, were placed in a monel reactor, which was evacuated then purged with nitrogen four times to remove any oxygen present in the reactor. Various mixtures of fluorine/sulfur dioxide/nitrogen were then admitted to the reactor at the varying reaction treatment times set forth in Table I below. Each gaseous mixture contained about 0.001% by volume of oxygen. The reaction took place at ambient temperature and pressure.

The treated samples were tested by standard procedures for the percent fluorine and sulfur dioxide incorporated into the fabric.

The tensile strength (by ASTM:D 1682-64) of the treated fabric was measured immediately after treatment, and one month after the treatment, in order to determine the effect the sulfo-fluorination treatment has on tensile strength. (Table I)

An evaluation of the wettability of the samples was made (according to the AATCC Test Method 39-1971) by mounting a sample of the fabric on an embroidery hoop and allowing one drop of water at 21 ± 3°C to fall on the taut surface of the sample every 5 seconds from a buret 1 cm above the surface. The time required for the specular reflection of the water drop to disappear was measured and recorded as wetting time, in seconds. As indicated by the results set forth in Table I below, the samples treated by the method of this invention have far superior wetting times than that of the control and negligible loss in strength has resulted.

The milliequivalents, according to *Anal. Chem.*, Vol. 26, p. 1614 (1954), increases with increasing reaction time, a result which parallels fluorination in the absence of $SO_2$. However, the presence of $SO_2$ has caused an increase in the acid content of the fabric over the values resulting from fluorination in the absence of $SO_2$.

TABLE I

TREATMENT OF NYLON FABRIC

| | Gaseous Mixture $F_2/SO_2/N_2$ Vol. % | Treat Time, Min. | %F/%S Incorporated by Weight | Tensile Strength After Treat lbs/in | Tensile Strength 1 Mo. Later lbs/in | Wicking Ht. 20min. mm | Wetting Time Seconds | Meq. per gram | Meg. per $cm^2 \times 10^{-5}$ |
|---|---|---|---|---|---|---|---|---|---|
| Control | — | — | — | 58.35 | — | 0 | 11,911 | 0.053 | 2.23 |
| 1A | 4/4/92 | 1 | 0.26/0.13 | 62.9 | 64.3 | 124 | 26.1 | 0.090 | 3.79 |
| 1B | 4/4/92 | 3 | 0.3/0.13 | 65.6 | 57.0 | 140 | 14.6 | 0.098 | 4.13 |
| 1C | 4/4/92 | 6 | 0.58/0.14 | 51.6 | 61.2 | 138 | 44.8 | 0.138 | 5.82 |
| 2A | 4/16/80 | 1 | 0.054/0.068 | 67.3 | 54.7 | 145 | 8.7 | 0.073 | 3.08 |
| 2B | 4/16/80 | 3 | 0.065/0.068 | 25.2 | 68.5 | 121 | 25.0 | 0.077 | 3.25 |
| 2C | 4/16/80 | 6 | 0.19/0.85 | 63.9 | 57.8 | 82 | 89.4 | 0.096 | 4.05 |
| 3A | 4/30/66 | 1 | 0.029/0.1 | 65.4 | 65.0 | 49 | 80.3 | 0.071 | 2.99 |
| 3B | 4/30/66 | 3 | 0.14/0.1 | 62.2 | 62.8 | 104 | 188.0 | 0.089 | 3.75 |
| 3C | 4/30/66 | 6 | 0.26/0.12 | 57.5 | 65.0 | 96 | 62.0 | 0.090 | 3.79 |

EXAMPLE 4

Polyester, 100%, was treated according to Examples 1–3 and tested for moisture transport and soil release properties. The table below summarizes the reaction conditions and test results.

| Sample | Reaction Conditions %$F_2$ | %$SO_2$ | Time | % X by Wt. Incorporated F | S | Wicking Hgt. mm | Soil Rel. |
|---|---|---|---|---|---|---|---|
| Control | — | — | — | — | — | 15 | 2 |
| 1870-33-1 | 1 | 1 | 1 | 0.067 | — | 97 | 5 |
| 1870-33-5 | 1 | 1 | 5 | 0.149 | — | 89 | 4.5 |
| 1870-32-1 | 1 | 10 | 1 | 0.044 | — | 106 | 5 |
| 1870-32-5 | 1 | 10 | 5 | 0.108 | — | 87 | 5 |
| 1870-34-1 | 4 | 10 | 1 | 0.105 | — | 91 | 5 |
| 1870-34-5 | 4 | 10 | 5 | 0.264 | — | 54 | 5 |
| 1833-2 | 4 | 1 | 6 | 0.07 | 0.017 | 108 | — |
| 1833-4 | 4 | 4 | 6 | 0.102 | 72ppm | 115 | — |
| 1833-5 | 4 | 8 | 6 | 0.17 | 75ppm | 116 | — |
| 1833-6 | 4 | 10 | 6 | 0.05 | 96ppm | — | — |

EXAMPLES 5–7

The greater enhancement in water transport and soil release attributable to sulfo-fluorination over fluorination can be seen well in the instance of nylon 6. For nylon 6, fluorination in the absence of $SO_2$ can be carried out so as to have a nominal effect on water transport properties. Sulfo-fluorination increases water transport substantially and improves soil release properties.

Nylon tricot jersey (Table 5) and Nylon tricot Crepeset (Table 6) were sulfo-fluorinated. The so treated materials showed better water transport than the control and a fluorinated sample.

Table 5

| Sample | Condition %F/%$SO_2$ | Time Mins | Nylon 6 - Jersey Wicking Hgt. mm in 20 min | % Incorporated by wt. F | S |
|---|---|---|---|---|---|
| Control | — | — | 43 | — | — |
| 1857-25 | 4/10 | 1 | 67 | 0.043 | 0.12 |
| 1867-27 | 4/4 | 1 | 97 | .21 | 0.033 |
| 1857-28 | 4/16 | 1 | 102 | .021 | 0.032 |
| 1857-37 | 1/10 | 3 | 88 | 0.027 | 0.034 |
| 1866-1 | 1/10 | 1 | 100 | 0.024 | 0.071 |
| 1866-3 | 1/10 | 3 | 94 | 0.023 | 0.059 |
| 1857-24 | 4/— | 1 | 24 | 0.265 | — |
| 1857-26 | 10/— | 1 | 27 | 0.22 | — |

Table 6

| Sample | Condition %F/%$SO_2$ | Time Mins | Nylon 6 - Crepeset Wicking Hgt. mm in 20 min | % Incorporated by wt. F | S |
|---|---|---|---|---|---|
| Control | — | — | 30 | — | — |
| 1857-25 | 4/10 | 1 | 64 | 0.087 | 0.11 |
| 1857-27 | 4/4 | 1 | 69 | 0.033 | 0.032 |
| 1857-28 | 4/16 | 1 | 94 | 0.030 | 0.032 |
| 1866-1 | 1/10 | 1 | 94 | 0.045 | 0.085 |
| 1866-3 | 1/10 | 3 | 81 | 0.047 | 0.045 |
| 1857-24 | 4/— | 1 | 17 | 0.14 | — |
| 1857-26 | 10/— | 1 | 24 | 0.10 | — |

Nylon carpet was sulfo-fluorinated (Table 7). This material showed better soil release (toward dyed mineral oil) than either the control or the fluorinated material.

The carpet was stained by mineral oil containing congo red and then placed in a beaker of warm water. The fluorinated carpet and the control did not release the mineral oil. In the sulfo-fluorinated carpet material, the mineral oil beaded and floated to the top of the water almost immediately.

Table 7

| Sample | Conditions %$F_2$/$SO_2$ | Time Min. | Nylon 6 Carpet Soil Release | % Incorporated by wt. F | S |
|---|---|---|---|---|---|
| Control | — | — | No | — | — |
| 1866-6 | 1/— | 3 | No | 0.029 | — |
| 1866-7 | 5/— | 3 | No | 0.039 | — |
| 1866/10 | 1/10 | 1 | No | 0.015 | 0.031 |
| 1866-10 | 1/10 | 6 | Yes | 0.015 | 0.029 |
| 1866-12 | 4/16 | 1 | Yes | 0.007 | 0.043 |
| 1866-12 | 4/16 | 6 | Yes | 0.007 | 0.091 |

EXAMPLE 8

Samples of 100% polypropylene fabric (fiber radius $21 \times 10^{-3}$ cm) were treated in the manner described in Examples 1–3, then tested for moisture transport and soil release properties against control specimens.

The soil release performance of each sample was measured by staining the fabric with a corn oil stain according to the AATCC Standard Test Method 130-1969. The stain release rating ranges from 5.0 to 1.0 with 5.0 measuring complete stain removal and 1.0 measuring absence of stain removal.

The moisture transport data for each sample was obtained by carrying out wicking height tests. In this test, a one-inch wide strip of the sample fabric was suspended above a container of water with a ¼ inch of fabric immersed in the water. The height of the dry fabric-wet fabric interface (above the water level) was measured as a function of time.

The results (Table 8) show that moisture transport is greatly improved by sulfo-fluorination, but that fluorination alone achieves equally superior soil release properties.

Table 8

| | Gas Mixture $F_2$/$SO_2$/$N_2$, Vol.% | Treatment of Polypropylene Fabric Treatment Time, Mins | %F Incorporated by wt | Wicking Hgt. mm | Soil Rel. Rtg. |
|---|---|---|---|---|---|
| A | — | — | — | 0 | 1.2 |
| B | 1/0/99 | 1 | 0.17 | 85 | 3.6 |

Table 8-continued

| | Gas Mixture $F_2/SO_2/N_2$, Vol.% | Treatment of Polypropylene Fabric Treatment Time, Mins | %F Incorporated by wt | Wicking Hgt. mm | Soil Rel. Rtg. |
|---|---|---|---|---|---|
| C | 1/0/99 | 5 | 0.49 | 47 | 5.0 |
| D | 5/0/95 | 1 | 0.49 | 16 | 4.75 |
| E | 1/0/98* | 1 | 0.17 | 77 | 5.0 |
| F | 1/0/98* | 5 | 0.18 | 71 | 5.0 |
| G | 1/0/94** | 1 | 0.10 | 64 | 5.0 |
| H | 1/0/94** | 5 | 0.26 | 50 | 5.0 |
| I | 4/0/95* | 1 | 0.44 | 61 | 5.0 |
| J | 4/0/95* | 5 | 1.03 | 52 | 5.0 |
| A | 1/1/98 | 1 | 0.098 | 131 | 4.75 |
| B | 1/1/98 | 5 | 0.152 | 128 | 5.0 |
| A | 1/10/89 | 1 | 0.079 | 125 | 4.5 |
| B | 1/10/89 | 5 | 0.204 | 122 | 5.0 |
| A | 4/10/86 | 1 | 0.353 | 116 | 5.0 |
| B | 4/10/86 | 5 | 0.367 | 127 | 5.0 |

*Gaseous mixture also contains 1 vol.% $O_2$
**Gaseous mixture also contains 5 vol.% $O_{vol.\%\ o}$

EXAMPLE 9

A spun Spandex fabric (3.9 oz/sq.yd.) was treated in the manner described in Examples 1-3. Spandex is a synthetic polymer which comprises at least 85% by weight of a segmented polyurethane. The treated samples were tested against control specimens.

Table 9

| Gaseous Mixture $F_2/SO_2/N_2$, Vol.% | Treatment of Polyurethane Fabric Treatment Time, min. | %F Incorporated by wt. | Wicking Hgt. mm. |
|---|---|---|---|
| — | — | — | 30 |
| 1/0/99 | 1 | 0.057 | 24 |
| 1/0/99 | 5 | 0.095 | 29 |
| 5/0/95 | 1 | 0.17 | 37 |
| 1/0/98* | 1 | 0.076 | 78 |
| 1/0/98* | 5 | 0.1 | 62 |
| 1/0/94** | 1 | 0.061 | 71 |
| 1/0/94** | 5 | 0.17 | 45 |
| 4/0/95* | 1 | 0.10 | 57 |
| 4/0/95* | 5 | 0.32 | 63 |
| 1/10/89 | 1 | 0.052 | 100 |
| 1/10/89 | 5 | 0.098 | 103 |
| 1/1/98 | 1 | 0.050 | 87 |
| 1/1/98 | 5 | 0.099 | 40 |
| 4/10/86 | 1 | 0.103 | 98 |
| 4/10/86 | 5 | 1.011 | 48 |

*Gaseous mixture also contains 1 vol.% $O_2$
**Gaseous mixture also contains 5 vol.% $O_2$

EXAMPLE 10

A polyurethane foam was sulfo-fluorinated according to the method of Examples 1-3, and the wetting time determined according to AATCC Test Method 39-1971. The results are shown in Table 10:

Table 10

| Sample | Reaction Conditions %$F_2$ | %$SO_2$ | Time (min) | %F Incorporated by wt. | Wetting Time-Sec. |
|---|---|---|---|---|---|
| Control | — | — | — | 0.018 | >2700 |
| 1838-12-1 | 4 | 16 | 1 | 0.104 | 315 |
| 1838-12-3 | 4 | 16 | 3 | .255 | 54 |

EXAMPLE 11

An acrylic fiber sold under the trademark ACRILAN was treated according to the method of Examples 1–3. Table 11 summarizes the reaction conditions and results:

Table 11

| | Reaction Conditions %$F_2$ | %$SO_2$ | Time(min) | %x Incorp. by wt. F | S | Wicking Hgt. mm-20 min. |
|---|---|---|---|---|---|---|
| Control | — | — | — | — | — | 38 |
| | 1 | 1 | 1 | 0.021 | 0.14 | 92 |
| | 1 | 1 | 3 | 0.019 | 0.15 | 111 |
| | 1 | 1 | 6 | 0.025 | 0.18 | 109 |
| | 1 | 1 | 25 | 0.18 | 0.18 | 107 |
| | 1 | 5 | 1 | 0.018 | 0.19 | 99 |
| | 1 | 5 | 3 | 0.032 | 0.21 | 113 |
| | 1 | 5 | 6 | 0.03 | 0.23 | 106 |
| | 1 | 5 | 25 | 0.16 | 0.19 | 114 |
| | 1 | 10 | 1 | 0.015 | 0.22 | 121 |
| | 1 | 10 | 3 | 0.024 | 0.22 | 95 |
| | 1 | 10 | 6 | 0.031 | 0.18 | 130 |
| | 1 | 10 | 25 | 0.023 | 0.20 | 121 |

EXAMPLE 12

High density polyethylene bottles, average wall thickness 24 mil, were treated according to the method of Examples 1–3, then tested for toluene permeability. The test involves retaining a (weighed) solvent containing sealed bottle in an oven maintained at 122°F for a total of 28 days and measuring the weight loss.

The test conditions and results are shown in Table 12:

Table 12

| Treatment of Polyethylene Bottles | | | |
|---|---|---|---|
| Gaseous Mixture $F_2/SO_2/N_2$, Vol.% | Treatment Time (min) | %F/%S Incorporated by wt. | %Wt. loss-122°F for 28 days |
| Control | — | — | 84.7 |
| 10/0/90 | 15 | 0.041/— | 6.64 |
| 4/10/86 | 15 | 0.015/59ppm | 5.9 |
| 4/4/92 | 15 | 0.015/16ppm | 5.0 |
| 10/50/40 | 15 | 0.017/0.017 | 18.3 |

Aside from the improvement in the oil barrier property attributable to the $SO_2$ reaction, it is noteworthy that lower fluorine incorporation levels may be employed, an economic advantage.

EXAMPLE 13

High density and low density polyethylene films were treated according to the method of Examples 1–3 and tested for tensile strength (ASTM D882-67) and percent elongation. The test results, shown in Tables 13A and 13B, show that the treatment can be conducted under circumstances which retain film strength.

Table 13-A

| Treatment of High Density Polyethylene Film | | | |
|---|---|---|---|
| Gaseous Mixture, $F_2/SO_2/N_2$, Vol.% | Treatment Time, Min. | Tensile Strength psi | %Elongation |
| Control | — | 3591 | 180 |
| 4/0/96 | 60 | 742 | 10 |
| 4/0/80* | 60 | 3754 | 200 |
| 1/10/89 | 60 | 3640 | 230 |
| 1/10/89 | 120 | 3787 | 160 |

*Gaseous mixture contains 16% by volume of $O_2$

Table 13-B

| Treatment of Low Density Polyethylene Film | | | |
|---|---|---|---|
| Gaseous Mixture, $F_2/SO_2/N_2$, Vol.% | Treatment Time, min. | Tensile Strength psi | %Elongation |
| Control | — | 2973 | 1123 |
| 1/10/89 | 60 | 2925 | 833 |
| 1/10/89 | 120 | 2258 | 620 |

EXAMPLE 14

Samples of high density polyethylene film were treated according to the method of Examples 1–3, then tested for oil barrier properties according to ASTM: F 119-70. The test results shown in Table 14 indicate that the sulfo-fluorination improves oil barrier resistance over fluorination treatment.

Table 14

| Oil Barrier Properties of Treated High Density Polyethylene Film | | |
|---|---|---|
| Gaseous Mixture, $F_2/SO_2/N_2$, Vol.% | Treatment Time, min. | Penetration Time, Hrs. at 140°F |
| Control | — | 12 |
| 5/0/95 | 5 | 15 |
| 5/0/95 | 10 | 27 |
| 5/0/95 | 15 | 27 |
| 5/0/95 | 35 | 47 |
| 5/0/95 | 75 | 102 |
| 4/1/95 | 60 | 192 |
| 4/4/92 | 60 | 53 |
| 4/8/88 | 60 | 53 |
| 4/10/80 | 60 | 167 |
| 4/40/56 | 60 | 192 |
| 5/10/85 | 5 | 32 |
| 5/10/85 | 10 | 43 |
| 5/10/85 | 15 | 27 |
| 5/10/85 | 30 | 72 |
| 5/10/85 | 45 | 72 |
| 5/10/85 | 63 | 72 |

EXAMPLE 15

In order to demonstrate that $SO_2$ inhibits fluorine incorporation, samples of polyolefin and polyacrylonitrile material were fluorinated, (a) in the absence of a coreactant gas, (b) in the presence of oxygen, and (c) in the presence of sulfur dioxide. Table 15 provides the reaction conditions and the resulting %F incorporated.

Table 15

| Reaction Conditions | | | |
|---|---|---|---|
| $\%F_2/\%X$ (by volume) | Time-Mins. | Material | %F Incorporated by wt. |
| 1/— | 1 | Polypropylene | 0.17 |
| 1/1 $O_2$ | 1 | Polypropylene | 0.17 |
| 1/1 $SO_2$ | 1 | Polypropylene | 0.10 |
| 1/— | 5 | Polypropylene | 0.49 |
| 1/1 $O_2$ | 5 | Polypropylene | 0.18 |
| 1/1 $SO_2$ | 5 | Polypropylene | 0.15 |
| 5/— | 15 | Polyethylene | 0.36 |
| 5/10 $O_2$ | 15 | Polyethylene | 0.25 |
| 5/10 $SO_2$ | 15 | Polyethylene | 0.26 |
| 1/— | 1 | Polyacrylonitrile | 0.035 |
| 1/1 $O_2$ | 1 | Polyacrylonitrile | 0.027 |
| 1/1 $SO_2$ | 1 | Polyacrylonitrile | 0.021 |

What is claimed is:

1. The process for improving the water transport or wicking properties of a synthetic polymer material which comprises sulfo-fluorinating the polymeric materials in a sealed reaction chamber by reacting said polymeric material with a self-activating gaseous medium comprising about 0.1 to about 20% by volume fluorine, 0.1 to about 50% by volume sulfur dioxide, not more than about 21% by volume oxygen, and the balance comprising inert gases for a time less than one hour and at a temperature for providing from $1 \times 10^{-9} \times 1 \times 10^{-3}$ mg fluorine and sulfur per square centimeter of polymeric material surface.

2. The method of claim 1 wherein the treatment time is less than about 15 minutes.

3. The method of claim 1 wherein the treating medium contains from 0.1–10% $F_2$ and 0.1–20% $SO_2$.

4. The method of treating fiber form synthetic resins selectd from the group consisting of polyamides, polyesters, polyolefins, and polyacrylonitriles for improving the water transport properties thereof, said method comprising sulfo-fluorinating said fibers by reacting said fibers with a self-activating gaseous reaction medium containing by volume from 0.1–10% fluorine, 0.1–20% sulfur dioxide, not more than about 5% oxygen, and the balance comprising inert gases for a time less than about 15 minutes and of a temperature providing from $1 \times 10^{-9}$ to $1 \times 10^{-3}$ mg of fluorine and sulfur per square centimeter of fiber surface.

5. The method of claim 4 wherein the fiber form synthetic resin is selected from the group consisting of polyamides and polyesters and the gaseous reaction medium is substantially free of oxygen.

* * * * *